US009614296B2

(12) United States Patent
Endo et al.

(10) Patent No.: US 9,614,296 B2
(45) Date of Patent: Apr. 4, 2017

(54) CONDUCTIVE TERMINAL FOR ELECTRICALLY CONNECTING A CIRCUIT CONDUCTOR AND ANOTHER CONNECTION TERMINAL

(71) Applicant: DAI-ICHI SEIKO CO., LTD., Kyoto (JP)

(72) Inventors: Takayoshi Endo, Shizuoka (JP); Hisashi Hamachi, Fukuoka (JP)

(73) Assignee: DAI-ICHI SEIKO CO., LTD. (JP)

( * ) Notice: Subject to any disclaimer, the term of this patent is extended or adjusted under 35 U.S.C. 154(b) by 0 days.

(21) Appl. No.: 15/041,810

(22) Filed: Feb. 11, 2016

(65) Prior Publication Data

US 2016/0248173 A1 Aug. 25, 2016

(30) Foreign Application Priority Data

Feb. 24, 2015 (JP) ..... 2015-034355

(51) Int. Cl.

| | |
|---|---|
| ***H01R 4/10*** | (2006.01) |
| ***H01R 4/18*** | (2006.01) |
| ***H01R 12/69*** | (2011.01) |
| ***H01R 13/187*** | (2006.01) |

(52) U.S. Cl.
CPC ..... *H01R 4/182* (2013.01); *H01R 12/69* (2013.01); *H01R 13/187* (2013.01)

(58) Field of Classification Search
CPC ..... H01R 4/185; H01R 4/188; H01R 4/2495; H01R 13/15; H01R 13/187
USPC ..... 439/877, 421, 422, 442, 852
See application file for complete search history.

(56) References Cited

U.S. PATENT DOCUMENTS

| | | | | |
|---|---|---|---|---|
| 5,733,154 A * | 3/1998 | Libregts | ..... | H01R 4/182 439/850 |
| 6,068,505 A * | 5/2000 | Sai | ..... | H01R 4/182 439/422 |

FOREIGN PATENT DOCUMENTS

| | | | | |
|---|---|---|---|---|
| JP | 10-275642 | 10/1998 | ..... | H01R 9/07 |
| JP | 3271925 | 1/2001 | ..... | H01R 12/08 |

* cited by examiner

*Primary Examiner* — Hae Moon Hyeon
(74) *Attorney, Agent, or Firm* — Hayes Soloway P.C.

(57) ABSTRACT

A conductive terminal includes: a connection terminal; a cylindrical body; and a contact piece housed in the cylindrical body. The cylindrical body includes a top plate. A pair of holes is opened through the top plate from both sides of a projection of the contact piece. A jig for applying force to the projection can be inserted into the cylindrical body via the pair of holes. The pair of side plates are provided with a catching unit that catches the contact piece, the projection of which is pressed onto the mounting surface to restrain movement thereof.

9 Claims, 12 Drawing Sheets

CONDUCTIVE TERMINAL FOR ELECTRICALLY CONNECTING A CIRCUIT CONDUCTOR AND ANOTHER CONNECTION TERMINAL

BACKGROUND OF THE INVENTION

1. Field of the Invention

The present invention relates a conductive terminal including a contact piece capable of electrically connecting a circuit conductor and another connection terminal.

2. Description of the Related Art

Conductive terminals with various shapes and functions suitable for electrical connection, such as a flat conductor, have been proposed. Reference 1 (Japan Registered Patent No. 3271925) discloses a "terminal _1" related to the present invention.

In order to assemble the "terminal _1", first, a worker presses a flexible printed circuit board (an FPC _2) placed on an installation surface _10a of a base _10 using a projection _16 of a contact spring _13. Next, while maintaining the pressing, the worker raises a holder _14 perpendicular to the base _10 toward the installation-surface _10a, and makes an engage protrusion _17a engage with an engaging hole _14a of the holder _14. Finally, the worker bends a cover _18 so as to support a fixed part _15 from an upper side of the contact spring _13. Thus, the worker electrically and mechanically connects the FPC _2 and the terminal _1.

LIST OF CITED REFERENCE(S)

Reference 1: Japan Registered Patent No. 3271925

SUMMARY OF THE INVENTION

There are problems in the "terminal _1" as discussed below. First, a free-end _17 of the contact spring _13 is engaged with the holder _14, and is kept stable. The fixed-end _15 thereof, however, abuts on no other member, and a position thereof is not limited. As a result, connection between a circuit conductor _21 and the contact spring _13 easily becomes unstable.

Second, after having contacting the contact spring _13 with the FPC _2, the worker must bend the cover _18 horizontally by 90 degrees so as to cover the contact spring _13. In short, connection work thereof is remarkably complicated.

Third, the contact spring _13 (contact piece) contacting with the FPC _2 is exposed outside, and a half of the contact spring _13 is always exposed outside even after the connection work has been completed. Accordingly, the contact spring _13 is easily damaged since electric current flows therethrough.

Thus, there are problems mentioned above according to the prior art.

In view of the above, an object of the present invention is to provide a conductive terminal with high connection stability, capable of easily connecting to a conductor plate, and of reducing damage of a contact piece.

A first aspect of the present invention provides a conductive terminal, comprising: a bottom plate formed with a mounting surface on which a conductor plate can be mounted, the bottom plate being in a shape of a flat plate; a pair of side plates extended from both sides of the bottom plate, each of the pair of side plates being in a shape of a flat plate; a top plate connected to both of the pair of side plates, the top plate being separated from the bottom plate, the top plate being in a shape of a flat plate; and a connection terminal capable of being connected to another connector, the connection terminal being provided with one open end of the bottom plate, wherein: the bottom plate, the pair of side plates, and the top plate form a cylindrical body having at least one end being an open end; the conductor plate is inserted into the cylindrical body via the open end to be mounted on the mounting surface; a contact piece has one end continuously-connected to the top plate and another end being extended from one open end of the bottom plate toward another open end of the bottom plate; the contact piece is an elastic and conductive plate housed in the cylindrical body; the contact piece includes a projection projecting toward the mounting surface and impressing elastic force to the conductor plate arranged between the contact piece and the mounting surface against the mounting surface to electrically connect to the conductor plate; a pair of holes are opened through the top plate from both sides of the projection; the pair of holes enables a jig to press the contact piece against the mounting surface so as to perform pressing the conductor plate by the projection; and the pair of side plates include a catching unit capable of catching the contact piece whose projection is pressed onto the mounting surface.

With this structure, since the contact piece for connecting to a conductor plate (e.g. a flat conductor) is always housed in the cylindrical body to be protected, the damage of the contact piece can be reduced. The conductor plate is inserted into the cylindrical body to be mounted on the mounting surface, and the jig is inserted via the holes of the top plate. After that, the pressing force is impressed to the contact piece against the mounting surface, and the contact piece is caught by the catching unit of the side plates of the cylindrical body. For this reason, work of connecting the contact piece to the conductor plate is easy. After the contact piece has been caught by the catching unit, the projection projecting toward the mounting surface of the contact piece keeps pressing the conductor plate against the mounting surface according to the elastic force thereof. In other words, the above conductive terminal and the conductor plate can be stably connected to each other.

A second aspect of the present invention provides, in addition to the first aspect, wherein the projection presses the conductor plate against the mounting surface at a center position in a direction that the contact piece is extended.

A third aspect of the present invention provides, in addition to the first aspect, wherein the pair of holes are arranged along a direction that the contact piece is extended.

A fourth aspect of the present invention provides, in addition to the first aspect, wherein: the contact piece includes a guide piece projecting toward the pair of side plates; a guide window is opened through each of the pair of side plates; and the guide piece is inserted into the guide window to control the contact piece caused by the pressing with the jig to move only in a direction toward the mounting surface.

A fifth aspect of the present invention provides, in addition to the first aspect, wherein the catching unit is composed of a pair of members; the pair of members are arranged opposing to each other from both sides of the contact piece; and two pairs of the catching units composed of the pair of members are included.

A sixth aspect of the present invention provides, in addition to the fifth aspect, wherein the two pairs of the catching units are positioned opposing to each other from both sides of the guide window.

A seventh aspect of the present invention provides, in addition to the fifth aspect, wherein the pair of holes opened through the top plate are located between the two pairs of the catching units.

An eighth aspect of the present invention provides, in addition to the first aspect, wherein: the contact piece further includes locking pieces projecting toward the side plates; and the catching unit is composed of engaging holes capable of engaging with the locking pieces.

An eighth aspect of the present invention provides, in addition to the first aspect, wherein: the conductive terminal is formed by bending a sheet of conductor plate member.

According to the present invention, the conductive terminal has excellent connection stability, can be easily connected to the conductor plate, and the damage of the contact piece can be reduced.

DETAILED DESCRIPTION OF THE PREFERRED EMBODIMENTS

Embodiment 1

Figure 1:
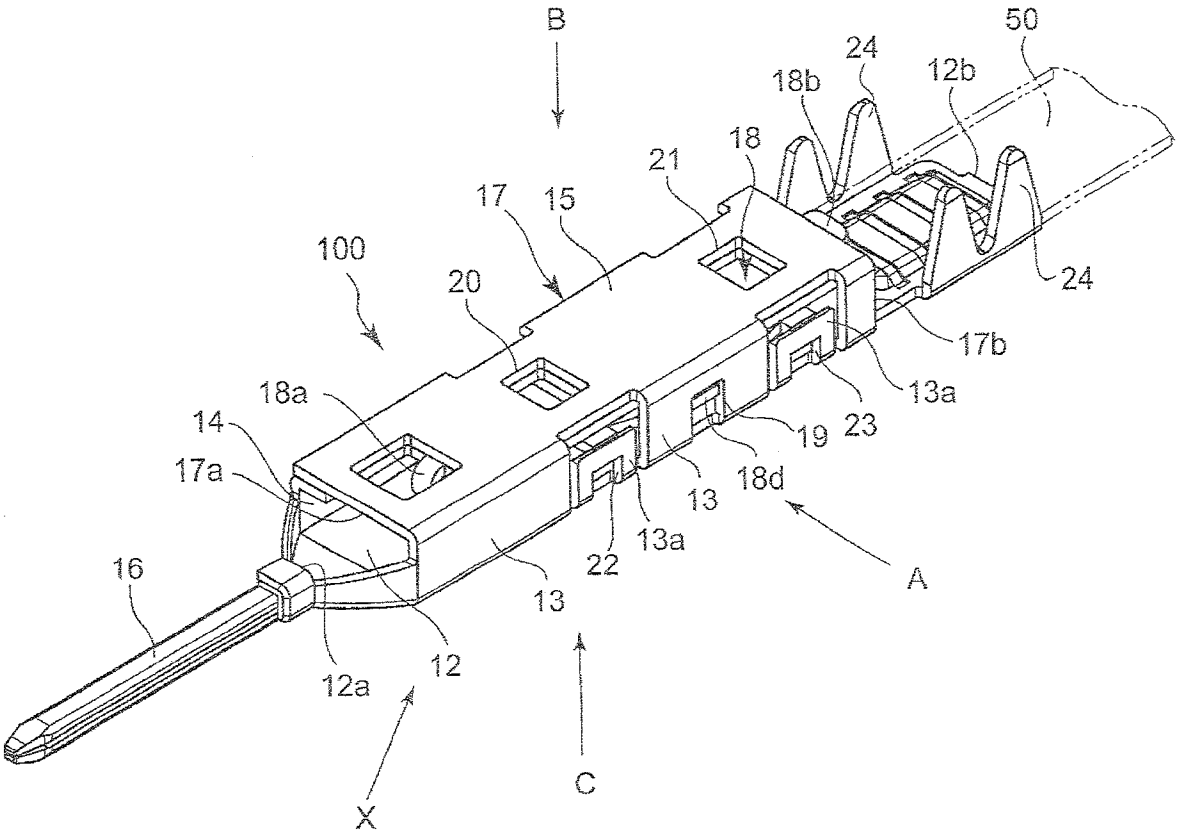
FIG. 1 is a perspective view of a conductive terminal in Embodiment 1 according to the present invention.
Figure 2:
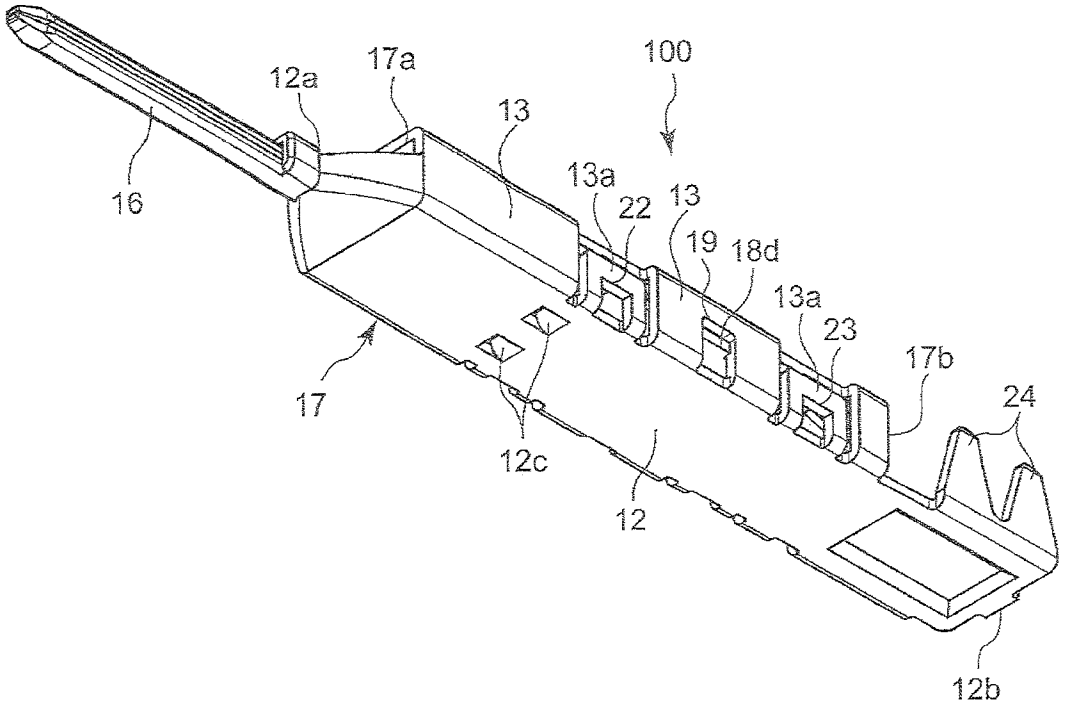
FIG. 2 is a perspective view by arrow X of FIG. 1.
Figure 3:
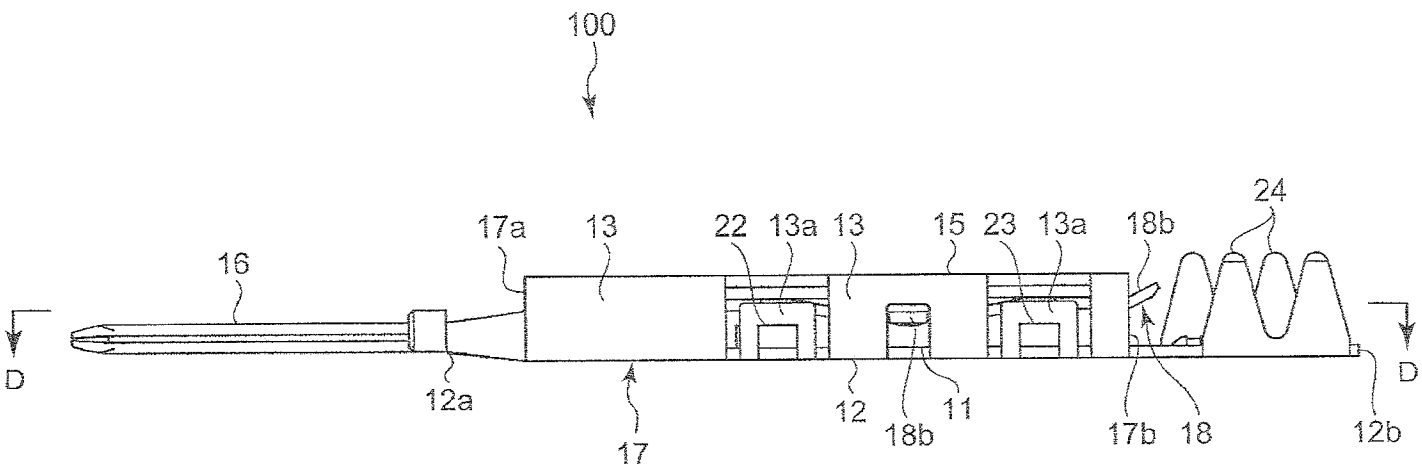
FIG. 3 is a side view by arrow A of FIG. 1.
Figure 4:
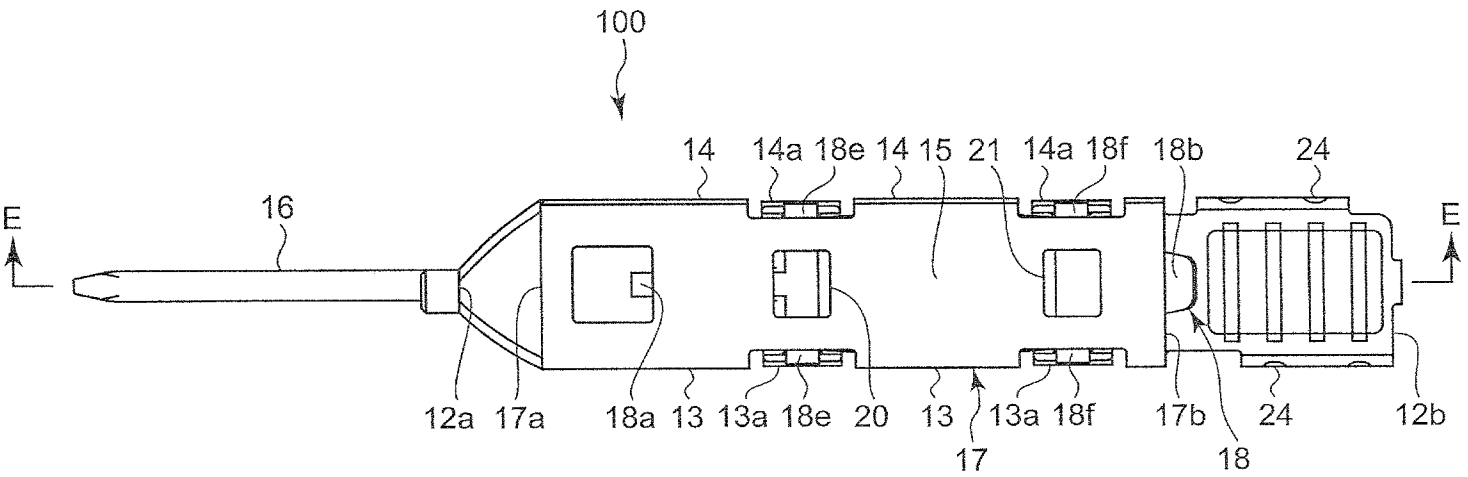
FIG. 4 is a plan view by arrow B of FIG. 1.
Figure 5:
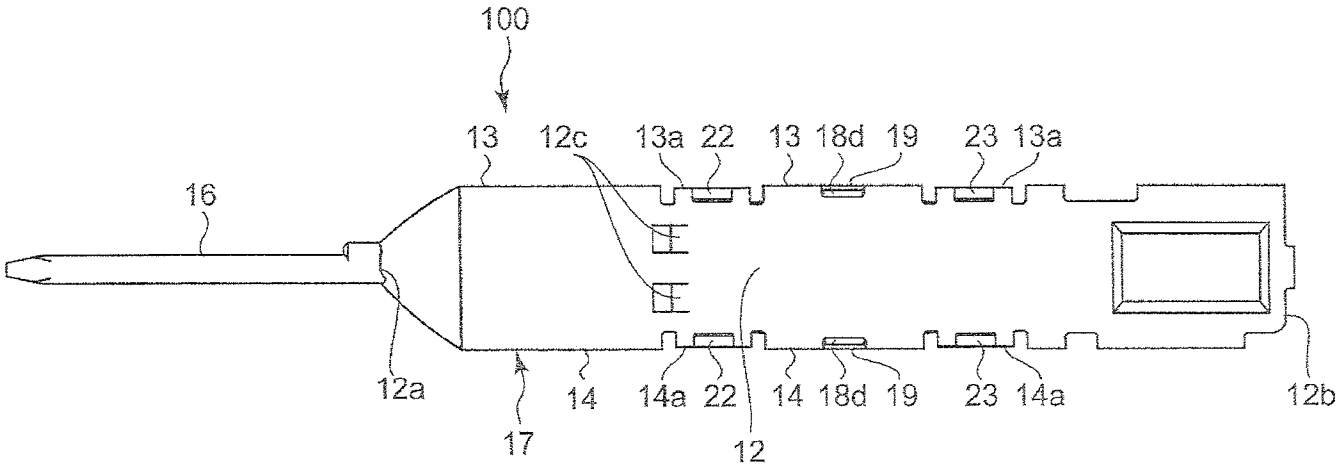
FIG. 5 is a bottom view by arrow C of FIG. 1.
Figure 6:
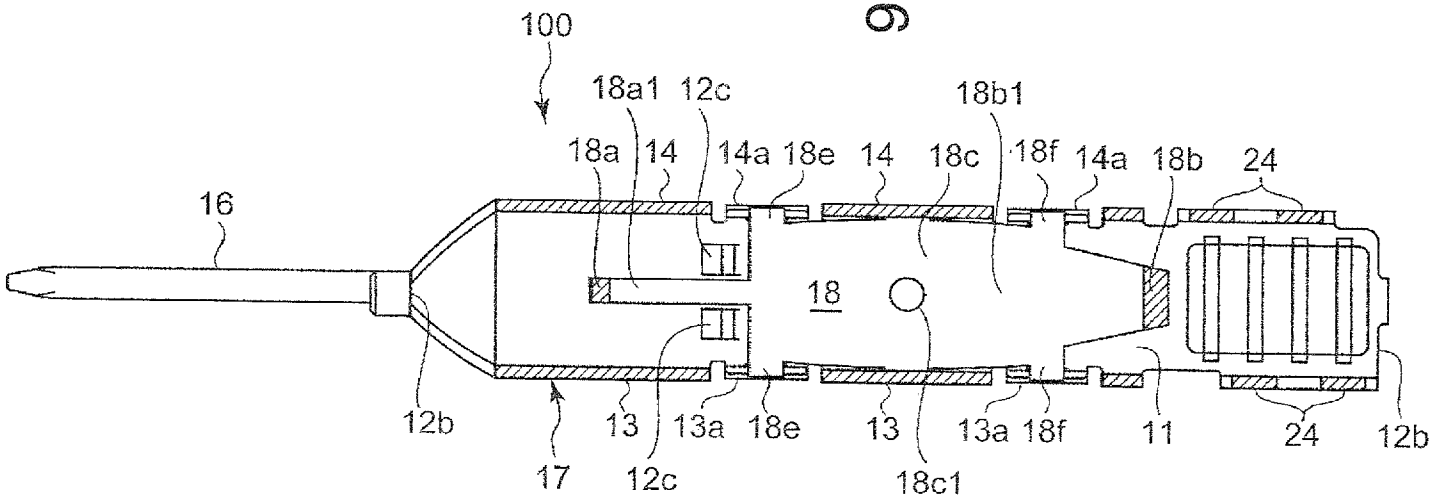
FIG. 6 is a sectional view by D-D line of FIG. 3.

Embodiments of the present invention are now described with reference to the accompanying drawings.

As shown in from FIG. 1 to FIG. 8, a conductive terminal 100 in this Embodiment includes: a flat bottom plate 12; a pair of side plates 13 and 14 connected to both ends of the bottom plate 12; and a flat top plate 15 connected to the side plates 13 and 14.

The bottom plate 12 is a conductive member, which is, for example, a metal plate. The bottom plate 12 includes, on a wide surface thereof opposing to the top plate 15, a mounting surface 11 on which a conductor plate 50 can be mounted (See, FIG. 8). The mounting surface 11 performs electrical connection with a conductor of the conductor plate 50. A flat board that has insulator on a bottom face thereof and that circuit conductors composed of copper foil or the like are formed on the insulator is an example of the conductor plate 50.

The side plates 13 and 14 are conductive members extending perpendicular to the mounting surface 11 of the bottom plate 12, which are, for example, flat metal plates. Engaging holes 22 and 23 mentioned below are formed through the side plates 13 and 14, respectively.

The top plate 15 is also a conductive member, which is, for example, a metal plate. The top plate 15 is separated from the bottom plate 12, and is connected to the side plates 13 and 14 almost in parallel to the mounting surface 11 of the bottom plate 12. The top plate 15, the side plates 13 and 14, and the bottom plate 12 are arranged as mentioned above to form a cylindrical body 17 both ends of which are opened.

The conductive terminal 100 is further provided with a conductive connection terminal 16 of a connector capable of being connected with another mating connector (not shown). The connection terminal 16 is connected to one open end 12*a* of the bottom plate 12, and projects outward from the open end 12*a* almost in parallel to a longitudinal direction of the bottom plate 12. When this connection terminal 16 is connected to the other mating terminal (e.g. a cylindrical terminal capable of being inserted the connection terminal 16 thereinto), the conductive terminal 100 and the other mating connector are mechanically and electrically connected.

From an insertion port 17*b*, which is positioned at a reverse side of the one open end 12*a* of the bottom plate 12, the conductor plate 50 is inserted into the cylindrical body 17, and then is placed on the mounting surface 11. The conductive terminal 100 also realizes electrical connection between the conductor plate 50 placed on the mounting surface 11 and the other connector.

When the conductor plate 50 is inserted into the cylindrical body 17, a distal end of the conductor plate 50 in an inserting direction abuts on a stopper 12*c*, which is a plate projecting from the wide surface of the bottom plate 12 toward the top plate 15. Then, the conductor plate 50 is positioned with respect to the inserting direction. Thus, the worker can easily mount the conductor plate 50 on the mounting surface 11.

Figure 8:
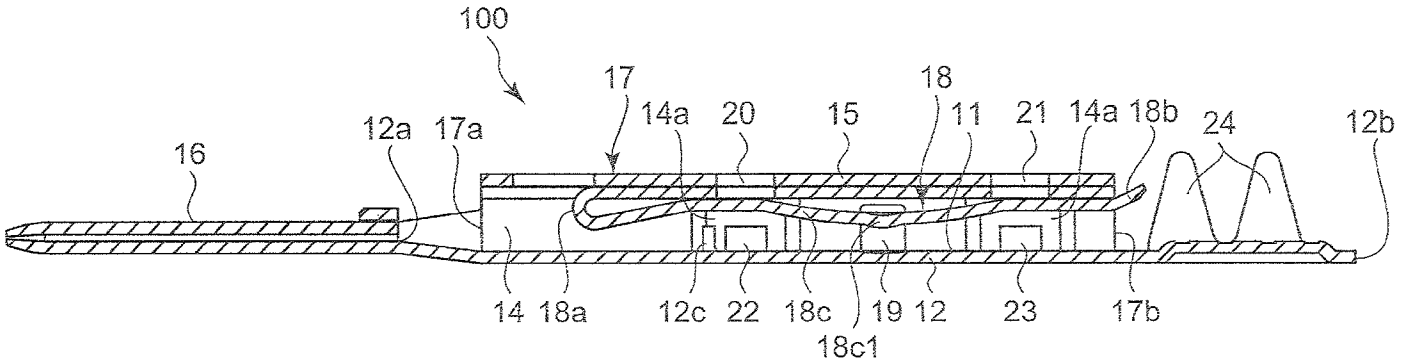
FIG. 8 is a sectional view by E-E line of FIG. 4.
Figure 9:
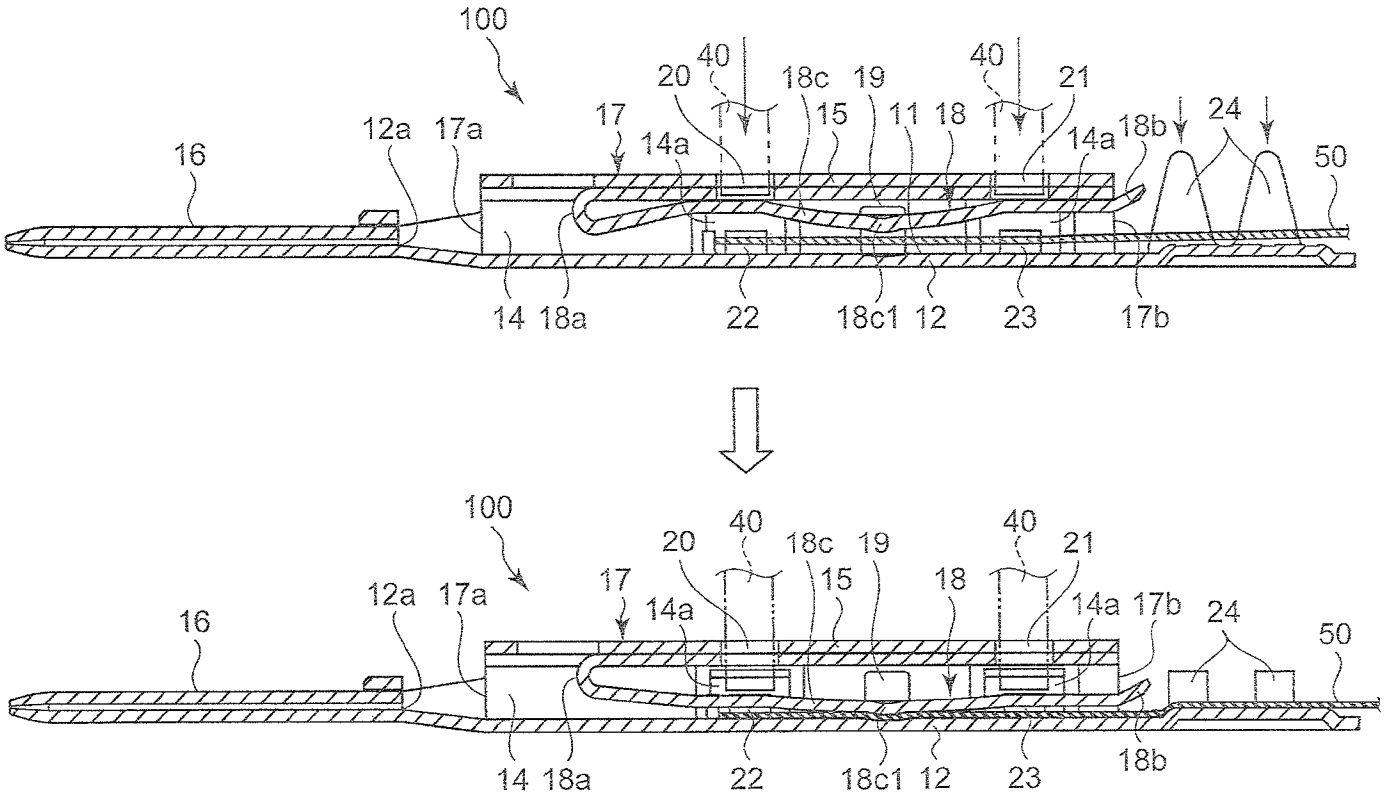
FIG. 9 is a flowchart showing press-bonding process of the contact piece in Embodiment 1 according to the present invention.

The conductive terminal 100 is continuously-provided with the top plate 15, and is provided with a contact piece 18 arranged in the cylindrical body 17. The contact piece 18 is a conductive and elastic plate, which is composed of, for example, a metal plate. As shown in FIG. 8 and FIG. 9, a part of the contact piece 18 between its proximal-end and its folded part 18*a* is flat, and is fixed to a bottom of the top plate 15. Another part of the contact piece 18 between its folded part 18*a* and its distal-end is a deflectable part, which is also deformable, and the deflectable part terminates at its end 18*b* extending to the outside of the cylindrical body 17.

Figure 7:
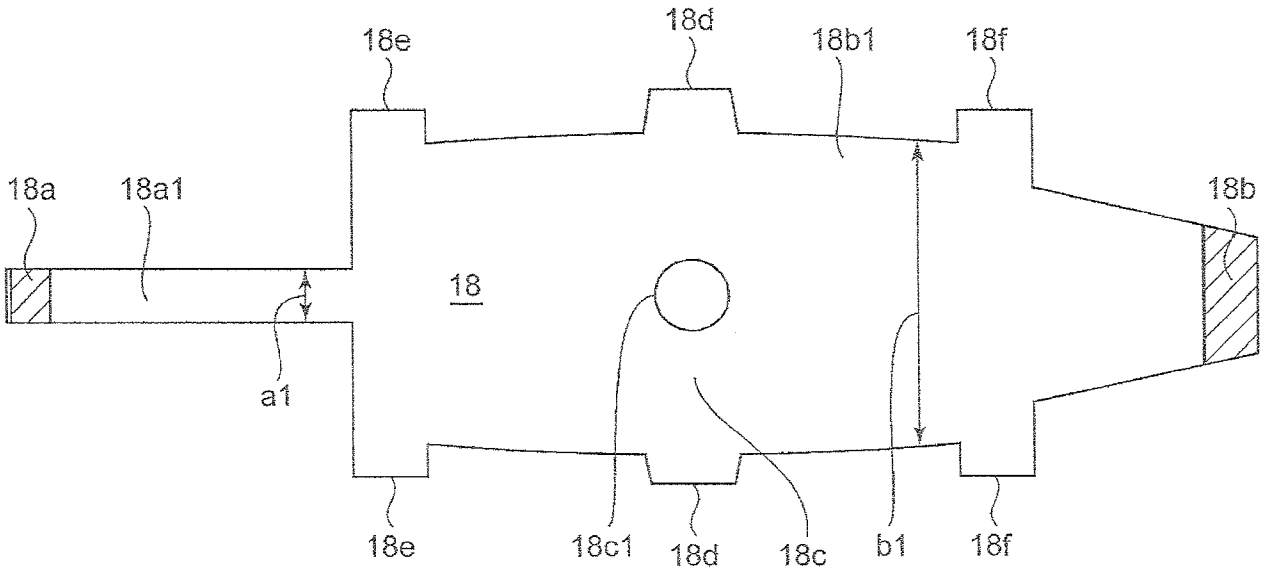
FIG. 7 is an enlarged view of a contact piece in Embodiment 1 according to the present invention.

More concretely, as shown in FIG. 7, the contact piece 18 includes: a rectangular small piece 18*a*1 provided with the folded part 18*a* connected to the top plate 15; and a large piece 18*b*1 provided with the end 18*b* extending toward an open end 12*b* side.

Another end of the small piece 18*a*1 is connected to a center portion of the large piece 18*b*1 in a width direction. The width direction is perpendicular to a direction in which the large piece 18*b*1 extends (from the folded part 18*a* to the end 18*b*). The folded part 18*a* of the small piece 18*a*1 is connected to the top plate 15.

As shown in FIG. 8, the small piece 18*a*1 is bent such that a bent portion (bent portion with a summit of the folded part 18*a*) faces to the connection terminal 16. Due to this, the large piece 18*b*1 is arranged so as to extend from the open end 12*a* of the bottom plate 12 toward the other open end 12*b* of the bottom plate 12.

A width a1 (a length a1 in a lateral direction) of the small piece 18*a*1 is narrower than a minimum of the width b1 of the large piece 18*b*1. Making the width of the small piece 18*a*1 narrower enables to adjust elastic force of the small piece 18*a*1, thereby, as shows in FIG. 8, keeping the contact piece 18 near the top plate 15.

There is also the following reason to narrow the width a1 of the small piece 18*a*1. That is, as described later, the worker presses the contact piece 18 to move toward the bottom plate 12. The width a1 of the small piece 18*a*1 is narrowed taking the movement into consideration. Therefore, the worker can make the contact piece 18 move with moderate pressing force, and also can uniformly press the large piece 18*b*1 in the width direction. Due to this, the worker's operability of moving the contact piece 18 can be improved.

As shown in FIG. 7, the large piece 18*b*1 possesses the following shape. That is, a width b1 (a length b1 parallel to the width a1 of the small piece 18*a*1) becomes wider from a portion connected to the small piece 18*a*1 to a center portion of the large piece 18*b*1, and becomes narrower from the center portion of the large piece 18*b*1 to the end 18*b*. Forming the large piece 18*b*1 as the above enables to realize the following effects comparing with a case where the large piece 18*b*1 is formed in a rectangular shape. That is, the contact piece 18 can be moved toward the bottom plate 12 without catching the contact piece 18 on the side plates 13 and 14. The area of the large piece 18*b*1 is reduced, thereby the metal plate for forming the contact piece 18 is effectively used.

As shown in FIG. 8, a distal end of the large piece 18*b*1, that is, the end 18*b* of the contact piece 18 is exposed from the cylindrical body 17, and is bent so as to separate from the bottom plate 12. This bending enables to guide the conductor plate 50 inserted into the cylindrical body 17. Due to this, the worker can easily insert the conductor plate 50 into the cylindrical body 17.

The bent portion at the end of the large piece 18*b*1 prevents the worker from accidentally inserting the conductor plate 50 into a space between the top plate 15 and the contact piece 18 when the conductor plate 50 is inserted into the cylindrical body 17.

The large piece 18*b*1 possesses a projection 18*c* at an area with the widest part of the width b1. The projection 18*c* presses the conductor plate 50 arranged on the mounting surface 11 with elastic force to electrically connect to the conductor plate 50, and projects so as to make a downward convex toward the mounting surface 11.

At a center portion in a direction that the contact piece 18 extends, more concretely, at a center portion between locking pieces 18*e* and 18*f* described later, the projection 18*c* presses the conductor plate 50 placed on the mounting surface 11.

In detail, a point of contact 18*c*1 of the projection 18*c* presses the conductor plate 50 placed on the mounting surface 11. The point of contact 18*c*1 is positioned on a line from a central portion of the locking pieces 18*e* and 18*f* described later (in other words, the folded part 18*a* of the contact piece) to the end 18*b*, and is further positioned on another line connecting guide pieces 18*d* and 18*d* mentioned below. Since the projection 18*c* is equipped with the point of contact 18*c*1 at this position, stable electrical connection with the conductor plate 50 placed on the mounting surface 11 can be realized.

Parts of the top plate 15 continuously-provided with the above contact piece 18 are opened to form a pair of holes 20 and 21. The holes 20 and 21 are provided so as to perform pressing to the conductor plate 50 using the projection 18*c*.

The worker inserts a jig 40 including a pair of projections from the holes 20 and 21, and presses the contact piece 18 toward the mounting surface 11 with the jig 40. Thereby, the contact piece 18 is deformed to move, thereby making the projection 18*c* press against the conductor plate 50.

The holes 20 and 21 are provided through the top plate 15 along a direction that the contact piece 18 extends such that the projection 18*c* is located between the holes 20 and 21. Due to this, the worker can press the contact piece 18 toward the mounting surface 11 in a well-balanced manner utilizing the jig 40.

As shown in FIG. 7, the pair of guide pieces 18*d* and 18*d* projecting toward outside (toward the side plates 13 and 14) are formed on the contact piece 18. As shown in FIG. 1, the guide pieces 18*d* and 18*d* are inserted into guide windows 19 and 19 formed through the side plates 13 and 14, respectively. The guide windows 19 and 19 are formed by opening parts of the side plates 13 and 14.

The guide windows 19 and 19 control movement of the contact piece 18 along a direction toward the mounting surface 11 when the contact piece 18 is pressed with the jig 40. As discussed above, the guide windows 19 and 19 enable to surely press the contact piece 18 (more concretely, the projection 18*c*) to the mounting surface 11.

As shown in FIG. 7, the pair of locking pieces 18*e* and 18*f* projecting outside (toward the side plates 13 and 14) are formed on the contact piece 18. The pair of locking pieces 18*e* and 18*f* are engaged with the pair of engaging holes 22 and 23 formed through the side plates 13 and 14, respectively, when the contact piece 18 is pressed toward the mounting surface 11.

The pair of engaging holes 22 and 23 are opened through the side plates 13 and 14. Portal portions 13*a* and 14*a*, which look like gates, are provided extending from the bottom plate 12 along the side plates 13 and 14. More concretely, the pair of engaging holes 22 and 23 are formed as a catching unit capable of catching the portal portions 13*a* and 14*a*.

When the pair of locking pieces 18*e* and 18*f* engage with the pair of engaging holes 22 and 23, respectively, the contact piece 18 (more concretely, the projection 18*c*) is forced to the mounting surface 11 while keeping elastic force.

The pair of these engaging holes 22 and 23 are arranged at positions opposing to each other via the contact piece 18, respectively. Herein, it is assumed that the pair of engaging holes 22 constitutes one set and the pair of engaging holes 23 constitutes another set, and that two pairs of the one set and the other set are provided in this Embodiment. Due to this, the pair of locking pieces 18*e* and 18*f* can be engaged with each other more stably than a case where only one pair of the one set and the other set is provided.

The two pairs of the one set and the other set are arranged such that the guide windows 19 and 19 are located therebetween. The conductive terminal 100 can engage with the pair of locking pieces 18*e* and 18*f* more stably than cases where the two pairs of the one set and the other set are NOT arranged such that the guide windows 19 and 19 are located therebetween, the cases including: a first case where the two pairs are arranged between the guide windows 19 and 19 and the one open end 12*a* of the bottom plate 12; and a second case where the two pairs are arranged between the guide windows 19 and 19 and the other open end 12*b*.

The holes 20 and 21 capable of inserting the jig 40 are arranged between each of the pair of engaging holes 22 and 23, respectively. Due to this, in the conductive terminal 100, pressing force from the jig 40 can be concentrated upon a place between the pair of locking pieces 18*f* and another place between the pair of locking pieces 18*e*. According to the conductive terminal 100, the pair of locking pieces 18*e* and 18*f* can be effectively engaged with the pair of engaging holes 22 and 23.

Figure 11:
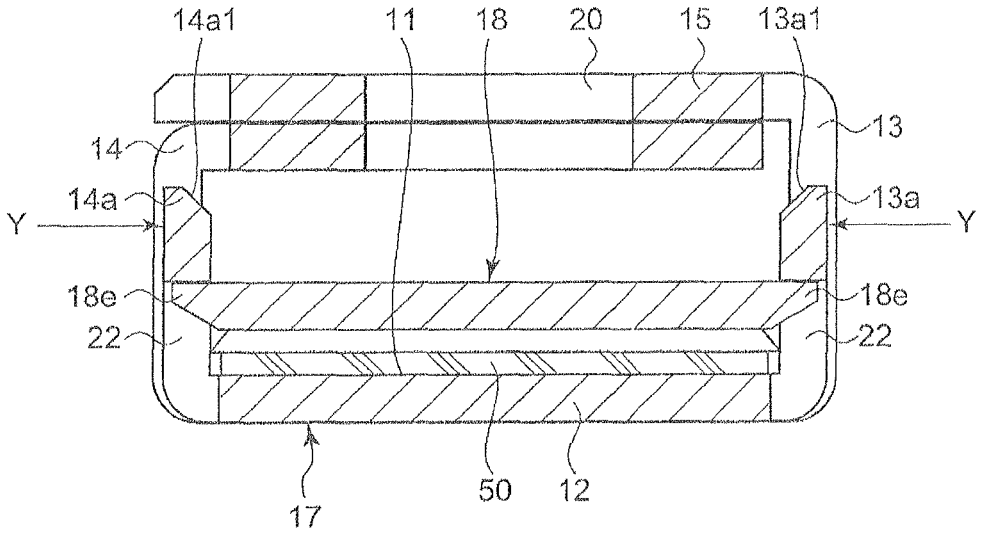
FIG. 11 is a sectional view by F-F line of FIG. 10.

As shown in FIG. 11, the pair of engaging holes 22 and 23 are formed with the portal portions 13*a* and 14*a*. The portal portions 13*a* and 14*a* include upper columns 13*a*1 and 14*a*1, respectively, each of which opposes to the top plate 15. And, the upper columns 13*a*1 and 14*a*1 include slopes for guiding the pair of locking pieces 18*e* and 18*f* toward the pair of engaging holes 22 and 23, respectively. Furthermore, the other slopes are formed on portions (lower portions of projecting distal ends) abutting on the slopes of the pair of locking pieces 18*e* and 18*f*. Accordingly, when the contact piece 18 moves downward toward the mounting surface 11, the pair of locking pieces 18*e* and 18*f* must be stably engaged with the pair of engaging holes 22 and 23.

As shown in FIG. 1, the conductive terminal 100 includes a plurality of crimping barrels 24 and 24 provided at both sides of the other open end 12*b* of the bottom plate 12. The crimping barrels 24 and 24 are formed with metal plates in a crest shape, for example. From a state of FIG. 1 to another state of FIG. 10, the worker caulks (bends) the crimping barrels 24 and 24 such that distal ends thereof face toward the bottom plate 12 to fix the conductor plate 50 inserted into the cylindrical body to the bottom plate 12.

Next, referring to from FIG. 9 to FIG. 11, work of connecting the conductive terminal 100 shown in FIG. 1 and the conductor plate 50 will now be explained. First, in an upper portion of FIG. 9, the contact piece 18 (more concretely, the above mentioned deflectable part of the contact piece 18, which is a portion between the folded part 18*a* and the end 18*b*) is in a non-contact position where the contact piece 18 does not contact with the conductor plate 50.

As shown in FIG. 9, the worker inserts the conductor plate 50 into the cylindrical body 17 from the insertion port 17*b* toward an opening 17*a*, and mounts the conductor plate 50 on the mounting surface 11. Then, as shown with two-dot lines in FIG. 9, the worker inserts a pair of projections of the jig 40 via the holes 20 and 21, respectively, and presses the contact piece 18 toward the mounting surface Then, the contact piece 18 is elastically deformed toward the mounting surface 11 to move downward to the bottom plate 12. The projection 18*c* presses the conductor plate 50 to the mounting surface 11 to electrically connect the point of contact 18*c*1 to a conductor on the conductor plate 50. At the same time, the pair of locking pieces 18*e* and 18*f* of the contact piece 18 are fitted into the pair of engaging holes 22 and 23, respectively. Due to this, the contact piece 18 holds the conductor plate 50 in a state where the conductor plate 50 is press-bonded to the mounting surface 11. That is, the contact piece 18 (more concretely, the above mentioned deflectable part of the contact piece 18, which is the portion between the folded part 18*a* and the end 18*b* moves to a crimping position where the contact piece 18 has been press-bonded to the conductor plate 50.

When the contact piece 18 is downward moving toward the mounting surface 11, the pair of locking pieces 18*e* and 18*f* make the portal portions 13*a* and 14*a* be elastically deformed such that the portal portions 13*a* and 14*a* are expanded outward, thereby the pair of locking pieces 18*e* and 18*f* approach and fit into the engaging holes 22 and 23, respectively. After the fitting has been completed, the portal portions 13*a* and 14*a* return to the substantially same plane as those of the side plates 13 and 14. In this way, the pair of locking pieces 18*e* and 18*f* are engaged with the pair of engaging holes 22 and 23 in a state where they can hardly be released from each other, respectively. In this Embodiment, a restraining mechanism that restrains and keeps the contact piece 18 at the crimping position includes: the pair of locking pieces 18*e* and 18*f*; and the engaging holes 22 and 23. The restraining mechanism, however, does not restrain the contact piece 18 at the non-contact position, as described above.

Figure 10:
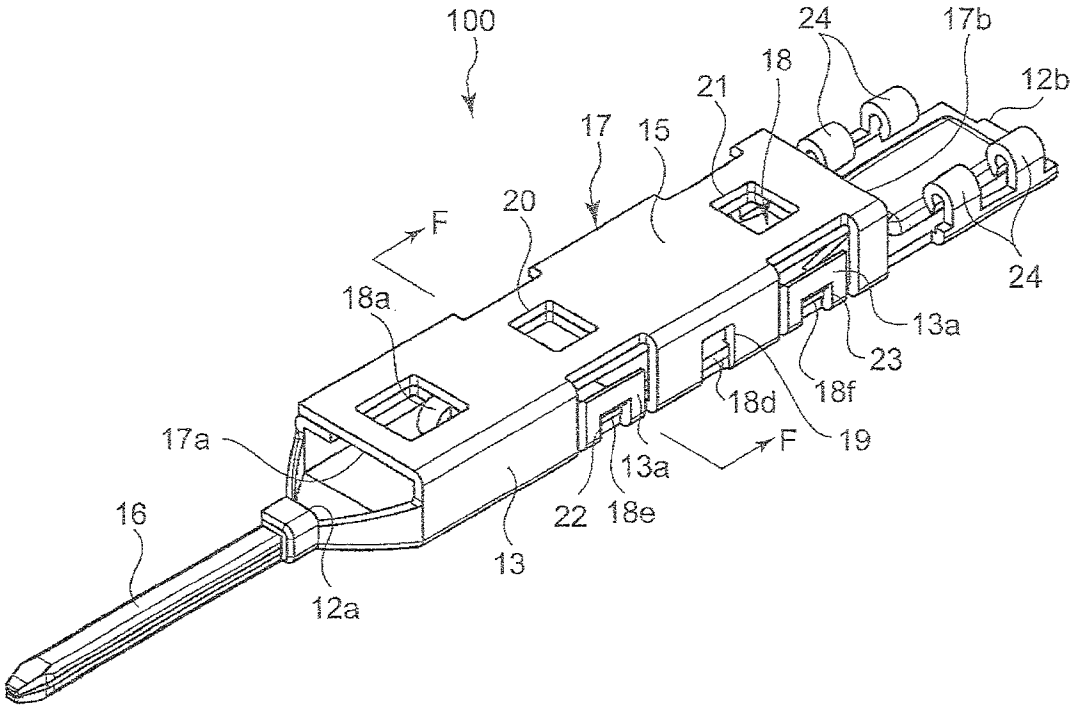
FIG. 10 is a perspective view of the conductive terminal in Embodiment 1 according to the present invention (after press-bonding)

The worker can fix a part of the conductor plates 50 exposing from the opening 17*b* of the cylindrical body 17 to the bottom plate 12 by pressing the crimping barrels 24 and 24 to be deformed (See, FIG. 10). FIG. 10 shows the conductive terminal 100 in a state where the conductor plate 50 is omitted after the crimping barrels 24 and 24 have been fixed.

As shown in FIG. 11, if the worker applies force in a direction of arrow Y to the portal portions 13*a* and 14*a* where the pair of engaging holes 22 and 23 are opened to caulk them, he can ensure engagement between the locking pieces 18*e* and 18*f* and the engaging holes 22 and 23 more stably.

In the above-mentioned conductive terminal 100, since the contact piece 18 for electrically connecting to the conductor plate 50 is always housed in the cylindrical body 17 to be protected, damage of the contact piece 18 can be prevented. Furthermore, in the conductive terminal 100, when the jig 40 is inserted from the holes 20 and 21 to press the contact piece 18 to the mounting surface 11 (after the conductor plate 50 has been inserted into the cylindrical body 17 and has been mounted on the mounting surface 11), the contact piece 18 is caught by the engaging holes 22 and 23 of the catching unit. For this reason, according to the conductive terminal 100, the work of connecting the conductor plate 50 can be performed very easily.

In the conductive terminal 100, after the contact piece 18 has been caught by the engaging holes 22 and 23, the projection 18*c* continues pressing the conductor plate 50 against the mounting surface 11 according to its elastic force. According to the conductive terminal 100, even if change with time makes the conductor plate 50 thinner, stability in connection with the conductor plate 50 can be maintained.

Figure 12:
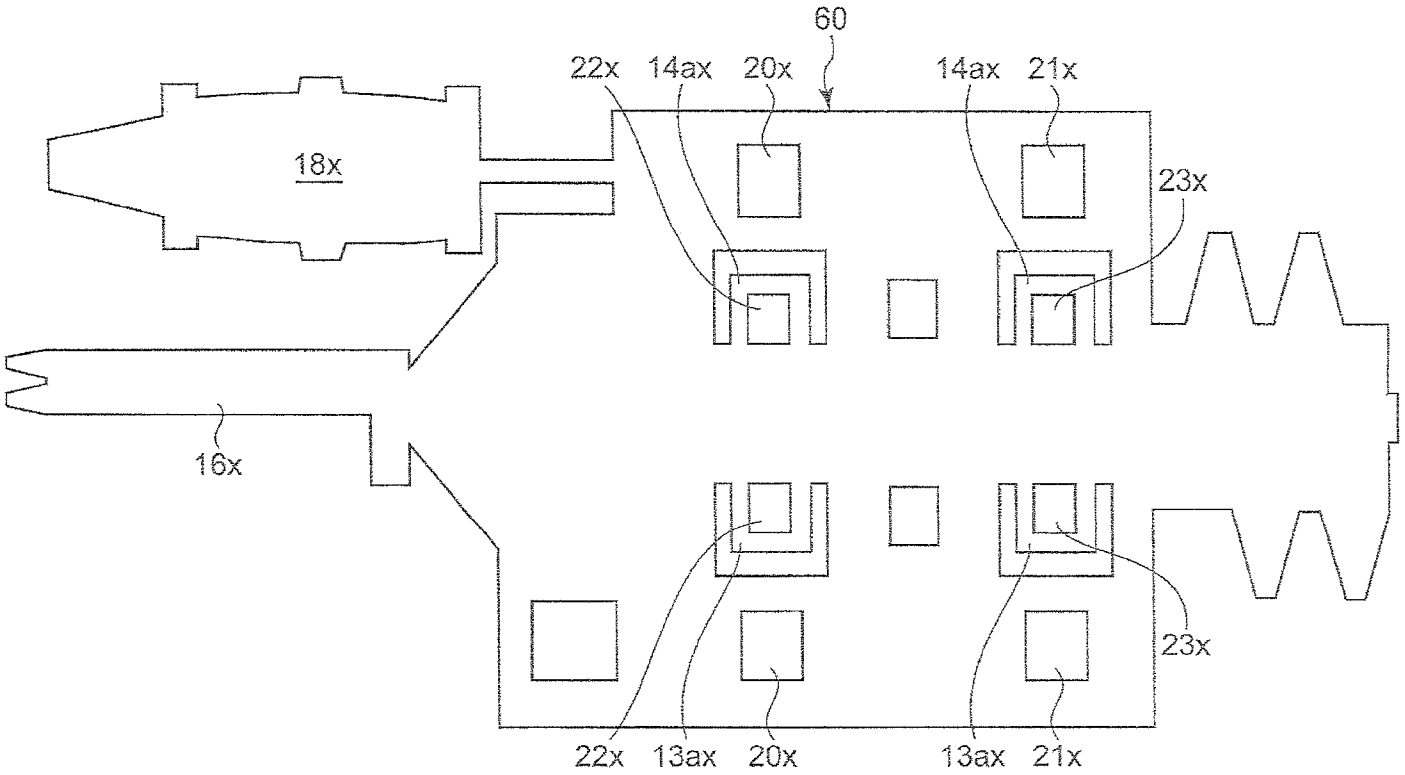
FIG. 12 is a developed view showing plate material for a conductive terminal in Embodiment 1 according to the present invention.

As shown in FIG. 12, the conductive terminal 100 is formed using a sheet of a conductor plate member 60 (for example, a metal plate). The conductor plate member 60 includes: an area 16*x* for the connection terminal 16; an area 18*x* for the contact piece 18; areas 20*x* and 21*x* c for the holes 20 and 21; areas 13*ax* and 14*ax* for the portal portions 13*a* and 14*a*; areas 22*x* and 23*x* for the engaging holes 22 and 23; and so on. For this reason, a maker can perform bending processes on the sheet of the conductor plate member 60 to assemble the conductive terminal 100.

According to the conductive terminal 100, since the conductive terminal 100 can be configured with the one sheet of the conductor plate member 60, the conductor plate member 60 can be effectively and economically used. According to the conductive terminal 100, efficiency of processes for manufacturing thereof can be also improved.

According to the conductive terminal 100, since the conductive terminal 100 can be configured with the one sheet of the conductor plate member 60, resistance when a high current is conducted therethrough can be reduced more effectively, and electrical connection with the other connector can be more stabilized than a case where the conductive terminal is configured using two or more conductive material members.

The conductive terminal 100 shown in from FIG. 1 to FIG. 12 is a mere example of the conductive terminal according to the present invention. That is, the conductive terminal according to the present invention is not limited to what is shown. Having described preferred embodiments of the invention with reference to the accompanying drawings, it is to be understood that the invention is not limited to those precise embodiments, and that various changes and modifications may be effected therein by one skilled in the art without departing from the scope of the invention as defined in the appended claims.

For example, in the conductive terminal 100 explained referring to from FIG. 1 to FIG. 12, both ends of the cylindrical body 17 are opened. The present invention, however, is not limited to this form. One end, which is near the connection terminal 16, of the cylindrical body 17 may be not opened, that is, may be closed, and the other end of the cylindrical body 17 may be opened.

In the conductive terminal 100 explained referring to from FIG. 1 to FIG. 12, the connection terminal 16 is formed at the one open end 12*a* of the bottom plate 12. The present invention, however, is not limited to this form. For example, if a certain connection terminal is provided with another mating connector to be connected to the conductive terminal 100, the open end 12*a* of the bottom plate 12 of the conductive terminal 100 may be provided with a cylindrical connection terminal into which the certain connection terminal can be inserted instead of the connection terminal 16. It is sufficient that the connection terminal provided at the one open end 12*a* of the bottom plate 12 can connect to the other connector. There is no limitation with respect to this matter.

In the conductive terminal 100 explained referring to from FIG. 1 to FIG. 12, the section of the cylindrical body 17 has a substantially rectangular shape. The present invention, however, is not limited to this form. For example, the shape of the section of the cylindrical body 17 may be circular, an ellipse, a polygon, or the like.

INDUSTRIAL APPLICABILITY

The conductive terminal according to the present invention can be widely employed as electric connecting means with a flat conductor or the like in fields, such as automobile industry, electrical industry, and so on.

BRIEF DESCRIPTION OF SYMBOLS

11: Mounting Surface
12: Bottom Plate
12*a* and 12*b*: Open end
12*c*: Stopper
13 and 14: Side plate
13*a* and 14*a*: Portal portion
15: Top Plate
16: Connection Terminal
17: Cylindrical Body
17*a*: Opening
17*b*: Insertion port
18: Contact Piece
18*a*: Folded part
18*b*: End
18*a*1: Small piece
18*b*1: Large piece
18*c*1: Point of contact
18*e* and 18*f*: Locking piece
19: Guide Window
20, 21: Hole
22 and 23: Engaging hole (catching unit)
24: Crimping Barrel
40: Jig
50: Conductor Plate
100: Conductive Terminal
a1, b1: Width

What is claimed is:

1. A conductive terminal, comprising:

a bottom plate formed with a mounting surface on which a conductor plate can be mounted, the bottom plate being in a shape of a flat plate;

a pair of side plates extended from both sides of the bottom plate, each of the pair of side plates being in a shape of a flat plate;

a top plate connected to both of the pair of side plates, the top plate being separated from the bottom plate, the top plate being in a shape of a flat plate; and a connection terminal capable of being connected to another connector, the connection terminal being provided with a first open end of the bottom plate, wherein:

the bottom plate, the pair of side plates, and the top plate form a cylindrical body having at least one end being a second open end;

the conductor plate is inserted into the cylindrical body via the second open end to be mounted on the mounting surface;

a contact piece has one end continuously-connected to the top plate and another end being extended from the first open end of the bottom plate toward the second open end of the bottom plate;

the contact piece is an elastic and conductive plate housed in the cylindrical body;

the contact piece includes a projection projecting toward the mounting surface and impressing elastic force to the conductor plate arranged between the contact piece and the mounting surface against the mounting surface to electrically connect to the conductor plate;

a pair of holes arc opened through the top plate from both sides of the projection;

the pair of holes enables a jig to press the contact piece against the mounting surface so as to perform pressing the conductor plate by the projection; and the pair of side plates include a catching unit capable of catching the contact piece whose projection is pressed onto the mounting surface.

2. The conductive terminal as defined in claim 1, wherein the projection presses the conductor plate against the mounting surface at a center position in a direction that the contact piece is extended.

3. The conductive terminal as defined in claim 1, wherein the pair of holes are arranged along a direction that the contact piece is extended.

4. The conductive terminal as defined in claim 1, wherein:

the contact piece includes a guide piece projecting toward the pair of side plates;

a guide window is opened through each of the pair of side plates; and the guide piece is inserted into the guide window to control the contact piece caused by the pressing with the jig to move only in a direction toward the mounting surface.

5. The conductive terminal as defined in claim 1, wherein the catching unit is composed of a pair of members;

the pair of members are arranged opposing to each other from both sides of the contact piece; and two pairs of the catching units composed of the pair of members are included.

6. The conductive terminal as defined in claim 5, wherein the two pairs of the catching units are positioned opposing to each other from both sides of the guide window.

7. The conductive terminal as defined in claim 5, wherein the pair of holes opened through the top plate are located between the two pairs of the catching units.

8. The conductive terminal as defined in claim 1, wherein:

the contact piece further includes locking pieces projecting toward the side plates; and the catching unit is composed of engaging holes capable of engaging with the locking pieces.

9. The conductive terminal as defined in claim 1, wherein the conductive terminal is formed by bending a sheet of conductor plate member.

* * * * *